US009975168B2

(12) United States Patent
Riondet et al.

(10) Patent No.: US 9,975,168 B2
(45) Date of Patent: May 22, 2018

(54) HEAT EXCHANGER TUBE, HEAT EXCHANGER AND CORRESPONDING PRODUCTION METHOD

(71) Applicant: Valeo Systemes Thermiques, Le Mesnil Saint Denis (FR)

(72) Inventors: Christian Riondet, Bourgogne (FR); Jean-Marc Lesueur, Bolt sur Suippe (FR); Kevin Gahon, Bourgogne (FR); Romain Dehaine, Reims (FR); Damien Burgaud, Reims (FR); Yann Pichenot, Longueval (FR); Xavier Marchadier, Levis Saint Nom (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 794 days.

(21) Appl. No.: 14/375,634

(22) PCT Filed: Jan. 29, 2013

(86) PCT No.: PCT/EP2013/051691
§ 371 (c)(1),
(2) Date: Jul. 30, 2014

(87) PCT Pub. No.: WO2013/113700
PCT Pub. Date: Aug. 8, 2013

(65) Prior Publication Data

US 2015/0047819 A1 Feb. 19, 2015

(30) Foreign Application Priority Data

Jan. 31, 2012 (FR) ..... 12 50900

(51) Int. Cl.
*B21D 53/06* (2006.01)
*F28F 3/02* (2006.01)
(Continued)

(52) U.S. Cl.
CPC ..... *B21D 53/06* (2013.01); *B21C 37/151* (2013.01); *F28D 1/0391* (2013.01); *F28F 1/00* (2013.01);
(Continued)

(58) Field of Classification Search
CPC ..... B21D 53/06; B21C 37/151; F28D 1/0391; F28F 1/00; F28F 1/022; F28F 3/025
See application file for complete search history.

(56) References Cited

U.S. PATENT DOCUMENTS 5,765,634 A 6/1998 Martins
5,825,668 A * 10/1998 Nakao ..... G01B 7/32 204/407
(Continued)

FOREIGN PATENT DOCUMENTS

DE 10 2008 007 601 A1 8/2009
EP 0 632 245 A1 1/1995
(Continued)

OTHER PUBLICATIONS

International Search Report for Application No. PCT/EP2013/051691 dated Mar. 6, 2013, 7 pages.
(Continued)

*Primary Examiner* — Tho V Duong
(74) *Attorney, Agent, or Firm* — Howard & Howard Attorneys PLLC

(57) ABSTRACT

The invention relates to a method for producing a heat exchanger tube (1) by bending a metal strip (11), said tube (1) having an internal partition (19) formed by joining the ends of opposing edges (11*a*, 11*b*), said partition facing a projection (50) that extends into the heat exchanger tube (1) at a joining zone (22). The method comprises the following steps: locally stamping the metal strip (11) in order to produce a projection at the joining zone (22); and bending
(Continued)

Figure 1:
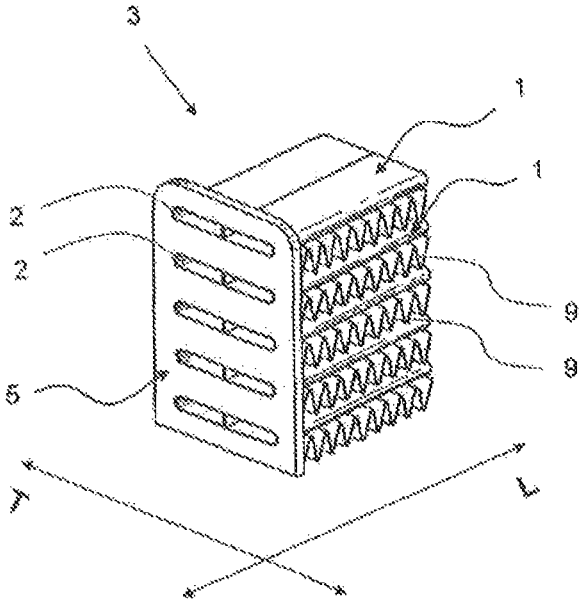

the metal strip (11) in order to form said heat exchanger tube (1), such that the projection extends into the tube (1). The invention also relates to such a tube (1) and to a heat exchanger (3) comprising a bundle of said tubes (1).

11 Claims, 3 Drawing Sheets

(51) Int. Cl.

| | |
|---|---|
| ***F28D 1/03*** | (2006.01) |
| ***F28F 1/02*** | (2006.01) |
| ***B21C 37/15*** | (2006.01) |
| ***F28F 1/00*** | (2006.01) |

(52) U.S. Cl.
CPC ..... *F28F 1/022* (2013.01); *F28F 3/025* (2013.01); *Y10T 29/49391* (2015.01)

(56) References Cited

U.S. PATENT DOCUMENTS

| | | | | | |
|---|---|---|---|---|---|
| 6,810,951 | B1 * | 11/2004 | Dumetz | F28F 9/182 165/173 |
| 2005/0184132 | A1 * | 8/2005 | Shabtay | B23K 1/0012 228/183 |
| 2007/0034366 | A1 * | 2/2007 | Igami | F28D 1/0391 165/177 |
| 2008/0072426 | A1 * | 3/2008 | Helms | F28D 1/0391 29/890.046 |

FOREIGN PATENT DOCUMENTS

| | | | | | |
|---|---|---|---|---|---|
| EP | 0 757 218 | A1 | | 2/1997 | |
| EP | 0 811 820 | A1 | | 12/1997 | |
| EP | 1 653 186 | A1 | | 5/2006 | |
| FR | 2 789 755 | A1 | | 8/2000 | |
| GB | 2509762 | B | * | 2/2015 | F28F 1/006 |
| JP | 2000-055582 | A | | 2/2000 | |
| JP | 2000055582 | A | * | 2/2000 | F28D 1/0391 |
| JP | 2001091178 | A | * | 4/2001 | F28D 1/0391 |

OTHER PUBLICATIONS

English language abstract and machine-assisted English translation for DE 10 2008 007 601 extracted from espacenet.com database on Sep. 11, 2014, 57 pages.
English language abstract and machine-assisted English translation for EP 0 632 245 extracted from espacenet.com database on Sep. 11, 2014, 32 pages.
English language abstract and machine-assisted English translation for EP 0 757 218 extracted from espacenet.com database on Sep. 11, 2014, 16 pages.
English language abstract for EP 0 811 820 extracted from espacenet.com database on Sep. 11, 2014, 1 page.
English language abstract and machine-assisted English translation for FR 2 789 755 extracted from espacenet.com database on Sep. 11, 2014, 26 pages.
English language abstract and machine-assisted English translation for JP 2000-055582 extracted from PAJ database on Sep. 11, 2014, 17 pages.

* cited by examiner

HEAT EXCHANGER TUBE, HEAT EXCHANGER AND CORRESPONDING PRODUCTION METHOD

RELATED APPLICATIONS

This application is the National Stage of International Patent Application No. PCT/EP2013/051691, filed on Jan. 29, 2013, which claims priority to and all the advantages of French Patent Application No. 12/50900, filed on Jan. 31, 2012, the content of which is incorporated herein by reference.

The invention relates to a method for producing a heat exchanger tube, in particular for motor vehicles, to a heat exchanger tube and to a heat exchanger comprising a core of heat exchanger tubes of this type.

Generally, the heat exchangers comprise a core having parallel heat exchanger tubes and two collectors having openings, to which the corresponding ends of the heat exchanger tubes are connected by brazing. The collectors are each equipped with an inlet and an outlet for a fluid, for example a coolant, which flows through the heat exchanger. The fluid therefore penetrates the heat exchanger tubes by means of the collectors.

Several types of technology are used to manufacture said tubes, and in this case, heat exchanger tubes produced using bending technology are discussed.

Generally, heat exchanger tubes of this type are produced from a reel of metal sheeting which, once unrolled to form a strip, is progressively shaped to the desired cross section using specific bending tools. After the bending, the longitudinal edges of the sheeting are joined to create one or more compartments in the heat exchanger tube. The heat exchanger tube can then be cut to the desired length, into portions corresponding to the final heat exchanger tubes.

The tubes can for example have a B-shaped cross section, having two substantially planar large parallel faces connected by two small curved faces.

A parameter to be taken into account when dimensioning the heat exchanger tubes is the mechanical stress during operation. Indeed, the heat exchanger tubes are subject in particular to the pressure of the circuit of which they are part.

A solution for increasing the mechanical strength of the heat exchanger tube is that of forming a spacer between the two large parallel faces. For example, the metal strip can be folded on itself by joining two opposing edges to form an internal partition. The internal partition separates the tube into two fluid circulation ducts. The internal partition abuts an opposing planar face common to the two ducts.

Another parameter to be taken into account when dimensioning the tubes is the efficiency of the desired exchange of heat.

In order to increase the efficiency of the exchange of heat, an internal divider may for example be arranged inside the tubes. Said internal divider, which is for example corrugated, disrupts the flow of the fluid in the tubes by increasing the exchange surface area. Said internal divider is also used to modify the internal pressure of the tubes. In order to arrange the internal divider in the heat exchanger tube, it may for example be provided that a gap is left between the internal partition and the opposing planar face. The internal divider thus passes through the two ducts of the tube.

However, the designer may want to use two internal dividers, that is to say one per circulation duct, or may not want to use any internal dividers. In this case, the gap between the internal partition and the opposing planar face is not filled, and the tube loses mechanical strength.

If the gap between the internal partition and the opposing face is greater than the brazing limit, that is to say greater than 100 μm, a solution consists in increasing the height of the internal partition in order to fill this gap. Drawbacks of this method are that it is time-consuming and requires specific tools.

The method set out in the following overcomes these drawbacks at least in part by putting in place a simple and cost-effective solution allowing the gap between the internal partition and the opposing planar face of the tube to be reduced without having to adapt the height of the internal partition.

For this purpose, the invention relates to a method for producing a heat exchanger tube having two fluid circulation ducts separated by an internal partition formed by joining opposing edges of a metal strip, said opposing edges each having an end opposite an inner wall of the tube at a joining zone, said method comprising the steps of:

- locally stamping the metal strip to produce a projection at the joining zone,
- bending the metal strip to form said heat exchanger tube having two fluid circulation ducts by joining the ends of the opposing edges at the stamped inner wall so that the projection is directed towards the inside of the heat exchanger tube.

According to another aspect of the method, the projection is positioned so as to be in contact with the ends of the opposing edges.

According to another aspect of the method, during an additional step:

- the metal strip is dimensioned so as to create a gap between the ends of the opposing edges and the inner wall of the tube at the joining zone, and in which
- the metal strip is stamped to produce a projection having a height that is less than or equal to the gap.

According to another aspect of the method, the gap is between 30 μm and 200 μm, preferably between 50 μm and 70 μm.

According to another aspect of the method, if the height of the projection is less than the gap, the height of the projection is selected such that the distance between the projection and the ends is less than 100 μm.

According to another aspect of the method, the ends and the projection are brazed together.

The invention also relates to a heat exchanger tube having two fluid circulation ducts separated by an internal partition formed by joining opposing edges of a metal strip, said opposing edges each having an end opposite an inner wall of the tube at a joining zone, the inner wall having a projection directed towards the inside of the heat exchanger tube at the joining zone.

According to another aspect of the tube, the inner wall of the projection is in contact with the ends.

According to another aspect of the tube, the thickness of the metal strip is between 0.15 mm and 0.35 mm, preferably between 0.20 mm and 0.27 mm.

The invention also relates to a heat exchanger, in particular for a motor vehicle, comprising a core of heat exchanger tubes.

The main advantage of the invention is that it allows the shape of a heat exchanger tube to be adapted to fill the space between the internal partition and the opposing face of the tube without having to modify the height of the internal partition thereof. The method described is simple and cost-effective, and allows the tube to maintain good mechanical strength.

Figure 2:
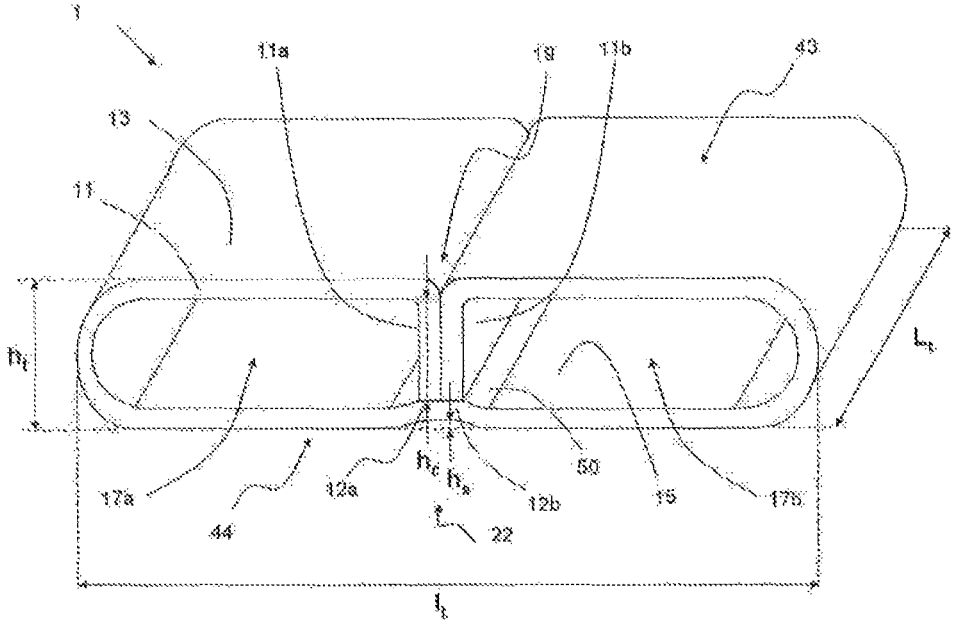
Figure 3:
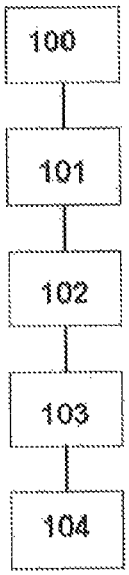
Figure 4A:
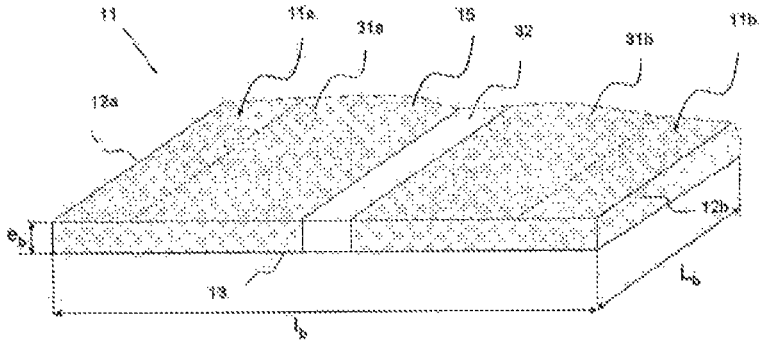
Figure 4B:
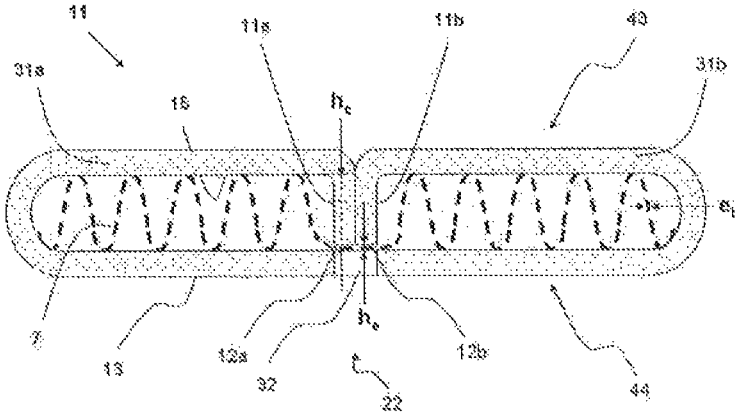
Figure 4C:
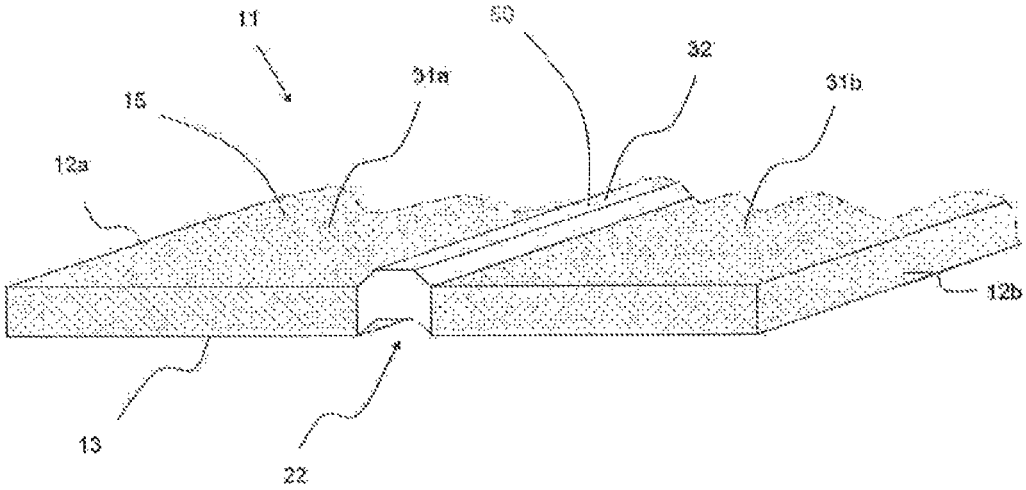

Other features and advantages of the invention will emerge more clearly upon reading the following description, which is given as an illustrative and non-limiting example, and from the accompanying drawings, in which:

FIG. 1 is a schematic partial view of a heat exchanger,

FIG. 2 is a perspective view of the heat exchanger tube produced by the above-described method, FIG. 3 is a flow diagram showing the steps of the method for manufacturing the heat exchanger tube, FIG. 4*a* is a schematic view of a metal strip which is used to form the heat exchanger tube, FIG. 4*a* not being representative of the dimensions of the strip for forming the heat exchanger tube, FIG. 4*b* is a schematic partial cross section of an exchanger tube, in which an internal divider is represented by dashes, FIG. 4*c* is a schematic view of the metal strip from FIG. 4*a* after having been stamped.

In these drawings, substantially like elements have the same reference numerals.

As partially shown in FIG. 1, a heat exchanger 3 conventionally comprises a core of heat exchanger tubes 1 (FIG. 1) in which a first fluid circulates by means of collectors 5 having openings 2 for receiving the ends of said tubes 1.

The heat exchanger 3 is substantially parallelepipedal, a longitudinal axis L is defined along the length of the heat exchanger 3 and a transverse axis T is defined over the width of the heat exchanger 3.

The heat exchanger tubes 1 may be separated from one another by external dividers 9, for example dividers which are corrugated in the direction of the axis L. A second fluid passes through said external dividers 9 so as to exchange heat with the first fluid.

The disruption produced by the presence of the external dividers 9 allows exchanges of heat between the two fluids to be made easier.

One of the objects of the method is that of producing a heat exchanger tube 1 (FIG. 2) having a height $h_t$, a length $L_t$ and a width $l_t$. The height $h_t$ of the tube 1 is for example between 1.0 mm and 2.0 mm, preferably between 1.2 mm and 1.6 mm. The dimensions of the tube 1 shown in FIG. 2 are not to scale.

The tube 1 is formed by bending a metal strip 11. The tube 1 has an outer wall 13 and an inner wall 15. The tube 1 has a substantially B-shaped cross section having a large face 43 and a second large face 44 which are in parallel and are interconnected by two small curved faces. The tube 1 also has an internal partition 19 positioned substantially in the middle of the parallel large faces 43, 44. Said internal partition 19 originates from the first large face 43 and is opposite a projection 50 positioned on the internal wall 15 of the second large face 44. The internal partition 19 forms the central bar of the B and divides the tube 1 into two fluid circulation ducts 17*a*, 17*b* which form the two loops of the B. The internal partition 19 forms a spacer between the first large face 43 and the second large face 44. The internal partition 19 has a height $h_c$.

The internal partition 19 is for example formed by opposing edges 11*a*, 11*b* of the metal strip 11 which are folded substantially at 90°. Said folded opposing edges 11*a*, 11*b* rest against each other to together form the partition 19. The outer walls 13 of the opposing edges 11*a*, 11*b* are in contact. Said opposing edges 11*a*, 11*b* each have an end 12*a*, 12*b*. Said ends 12*a*, 12*b* are opposite the inner wall of the projection 50 of the second large face 44 at the joining zone 22.

Said projection 50 has a height $h_s$, said height $h_s$ being defined as how far the projection 50 goes inside the tube 1. Said height $h_s$ is for example between 30 μm and 200 μm, preferably 50 μm to 100 μm, preferably 50 μm to 70 μm.

The height $h_s$ of the projection 50 is preferably selected such that once the tube 1 is bent, the ends 12*a*, 12*b* are in contact with the projection 50. Alternatively, the ends 12*a*, 12*b* and the inner wall 15 of the projection 50 are separated by a distance. Said distance is less than 100 μm, that is to say the brazing limit. The ends 12*a*, 12*b* and the inner wall 15 of the projection 50 may be easily brazed. A good mechanical strength is thus achieved.

Reference is now made to FIG. 3, which shows the steps for producing a heat exchanger tube, as well as to FIGS. 4*a*, 4*b*, 4*c* and 2, which illustrate some of these steps.

With reference to FIG. 3, the method for producing a heat exchanger tube 1 of this type is described.

The method may comprise a preliminary step 100 for dimensioning the tube 1.

Said tube 1 is produced from a metal strip 11. The metal strip 11 is preferably made of aluminium or aluminium alloy. The strip 11 is shown schematically and by way of illustration in FIG. 4*a*. To aid understanding, the drawings are not to scale.

The strip 11 is for example of a rectangular general shape and comprises a first wall, referred to as an outer wall 13, and a second wall, referred to as an inner wall 15, in parallel with and opposite the outer wall 13. The terms "inner" and "outer" are defined with respect to the inside and the outside of the bent tube 1. Thus, once the strip 11 is bent, the outer wall 13 of the strip 11 forms the outer wall 13 of the heat exchanger tube 1 thus formed, and the inner wall 15 of the strip 11 forms the inner wall 15 of the heat exchanger tube 1 thus formed (see FIG. 2).

The strip 11 (FIG. 4*a*) has a length $L_b$, a width $l_b$ and a thickness $e_b$. The thickness $e_b$ is for example between 0.15 mm and 0.35 mm, preferably between 0.20 mm and 0.30 mm, preferably between 0.20 and 0.27 mm.

The strip 11 has opposing longitudinal edges 11*a*, 11*b*. The edges 11*a*, 11*b* each have an end 12*a* and 12*b*.

The length $l_b$ of the strip 11 is selected so that once bent, the edges 11*a*, 11*b* rest against each other to together form the internal partition 19. The ends 12*a*, 12*b* are opposite the internal wall 15 of the second large face 44 of the tube 1, without touching said face. The height $h_c$ of the internal partition 19 is defined such that the ends 12*a*, 12*b* are separated from the inner wall 15 of the second large face 44 by a gap $h_e$ (FIG. 4*b*). This gap $h_e$ allows an internal divider 7, if used, represented by dashes and having a thickness $e_i$, to be arranged in the tube 1. The value of the gap $h_e$ corresponds substantially to the thickness $e_i$ of the internal divider 7. This thickness $e_i$ is between 30 μm and 200 μm, preferably 50 μm to 100 μm, preferably 50 μm to 70 μm.

When an internal divider 7 is to be used through the ducts 17*a*, 17*b*, or when internal dividers 7 are not to be used, the gap $h_e$ is no longer necessary. Said gap therefore needs to be filled so that the tube 1 has good mechanical strength. For this purpose, it is provided that the strip 11 is deformed.

A plurality of portions of the strip 11 can be delimited in order to determine where the deformation will be positioned (FIG. 4*a*).

First portions 31*a*, 31*b*, represented by dots, and a second portion 32 are defined according to the cross section that the tube 1 is to be given. In the present example, a B-shaped cross section is to be produced.

The second portion 32 is positioned at the joining zone 22 between the ends 12*a*, 12*b* and the inner wall 15 of the tube 1. According to the example shown, the joining zone 22 is defined substantially in the centre of the width $l_b$ of the strip 11, and the two first portions 31*a*, 31*b* are on either side of the joining zone 22.

It is provided that the strip is deformed at the second portion 32 of the strip 11.

During the step 101 (FIG. 3), the outer wall 13 of the tube 1 is stamped. According to the example described, the outer wall 13 of the portion 32 is stamped (FIG. 4*c*). A first wheel is engaged on the outer wall 13 of the strip 11. A projection 50 is thus produced at the joining zone 22.

According to a first variant, the height $h_s$ of the projection 50 is selected so that said projection 50 is in contact with the ends 12*a*, 12*b* once the strip 11 is bent. In this case, the height $h_s$ of the projection 50 is equal to the gap $h_e$, that is to say is between 30 μm and 200 μm.

According to a second variant, the height $h_s$ of the projection 50 is less than the gap $h_e$. In this case, the height $h_s$ of the projection 50 is selected so that the distance between the projection 50 and the ends 12*a*, 12*b* is less than 100 μm, that is to say the brazing limit, once the strip 11 is bent.

By way of example, if the gap $h_e$ is equal to 200 μm, the height $h_s$ of the projection 50 is equal to 100 μm.

Preferably, the height $h_s$ of the projection 50 is between 50 μm and 70 μm. In all cases, the difference between the gap $h_e$ and the height $h_s$ of the projection 50 is less than or equal to 100 μm, that is to say the brazing limit.

In addition to this step, localised stamping can be provided together with global stamping of the metal strip 11. In this case, second wheels are used to produce bosses on the entire strip 11. The bosses thus formed will disrupt the flow of the fluid in the fluid circulation ducts 17*a*, 17*b* and will improve the exchanges of heat.

During a step 102, the metal strip 11 is bent to form the two fluid circulation ducts 17*a*, 17*b* (FIG. 2) by joining the opposing edges 11*a*, 11*b* at the joining zone 22. For example, the opposing edges 11*a*, 11*b* can be bent to substantially 90° and two portions of the strip 11 which will form the two small curved faces of the tube 1 can be curved over.

It is therefore conceivable to insert one or more internal dividers 7 into each duct 17*a*, 17*b* of the bent tube 1.

Finally, the opposing edges 11*a*, 11*b* are folded down so as to rest against each other. The tube 1 is thus closed and the internal partition 19 of the heat exchanger tube 1 is thus formed.

The internal divider 7, if used, may therefore be inserted during bending, before the strip 11 is completely folded up.

If the height $h_s$ of the projection 50 is equal to the gap $h_e$, then the ends 12*a*, 12*b* are in contact with the inner wall 15 of the projection 50.

If the height $h_s$ of the projection 50 is less than the gap $h_e$, the distance between the ends 12*a*, 12*b* and the inner wall 15 of the projection 50 has to be less than 100 μm in order to allow brazing. This distance is less than 100 μm (that is to say less than the brazing limit).

The bent strip 11 has the height $h_t$, the width $l_t$ and the length $L_B$. The general shape of the bent strip 11, and consequently of the tube 1, is not affected by the projection 50. The tube 1 may therefore be easily inserted into the openings 2 in the collectors 5 of the heat exchanger 3.

Once the bending is complete, during a step 103, the strip 11 of length $L_b$ in which the internal divider(s) 7 are optionally arranged may be cut to form heat exchanger tubes 1 of length $L_t$.

According to a variant, the metal strip 11 of length $L_b$ is cut to the desired length $L_t$ of the tube 1 before the internal divider(s) 7 are inserted, if being used.

Finally, during a step 104, the ends 12*a*, 12*b*, the internal divider(s) 7, if used, and the inner wall 15 of the tube 1 can be connected by being brazed together.

It is therefore understood that this method allows the shape of a heat exchanger tube 1 to be easily adapted, depending on whether or not it is intended to contain an internal divider 7. This method allows good mechanical strength to be conferred on the tube 1 without the height hc of the internal partition having to be changed and without changing the general shape of the tube 1.

The invention claimed is:

1. A method for producing a heat exchanger tube (1) having two fluid circulation ducts (17*a*, 17*b*) separated by an internal partition (19) formed by joining opposing edges (11*a*, 11*b*) of a metal strip (11) such that said joined opposing edges (11*a*, 11*b*) are in direct contact, said opposing edges (11*a*, 11*b*) each having an end (12*a*, 12*b*) opposite an inner wall (15) of the tube (1) at a joining zone (22), said method comprising the steps of:

locally stamping the metal strip (11) to produce a projection (50) at the joining zone (22);

bending the metal strip (11) to form said heat exchanger tube (1) having two fluid circulation ducts (17*a*, 17*b*) by joining the ends (12*a*, 12*b*) of the opposing edges (11*a*, 11*b*) at the stamped inner wall (15) so that the projection (50) is directed towards the inside of the heat exchanger tube (1) and such that the tube (1) has a gap ($h_e$) between the ends (12*a*, 12*b*) of the opposing edges (11*a*, 11*b*) and the inner wall (15) of the tube (1) corresponding to the projection (50), wherein the metal strip is dimensioned such that the height (hg) of the projection (50) is less than the gap ($h_e$), and brazing the faces of the ends (12*a*, 12*b*) and the projection within the gap ($h_e$).

2. The method for producing a heat exchanger tube (1) according to claim 1, wherein the gap $h_e$ is between 30 μm and 200 μm.

3. The method for producing a heat exchanger tube (1) according to claim 1 wherein the height $h_s$ of the projection (50) is selected such that the distance between the projection (50) and the ends (12*a*, 12*b*) is less than 100 μm.

4. A heat exchanger tube (1) having two fluid circulation ducts (17*a*, 17*b*) separated by an internal partition (19) formed by joining opposing edges (11*a*, 11*b*) of a metal strip (11) such that said joined opposing edges (11*a*, 11*b*) are in direct contact, said opposing edges (11*a*, 11*b*) each having an end (12*a*, 12*b*) opposite an inner wall (15) of the tube at a joining zone (22), wherein the inner wall (15) has a projection (50) directed towards the inside of the heat exchanger tube (1) at the joining zone (22), and wherein said ends (12*a*, 12*b*) are joined;

wherein the tube (1) has a gap ($h_e$) between the ends (12*a*, 12*b*) of the opposing edges (11*a*, 11*b*) and the inner wall (15) of the tube (1) corresponding to the projection (50), wherein the projection (50) and the faces of the ends (12*a*, 12*b*) are brazed together within the gap ($h_e$); and wherein the projection (50) has a height ($h_s$) that is less than the gap ($h_e$).

5. The heat exchanger tube (1) according to claim 4, wherein the gap ($h_e$) is between 30 μm and 100 μm.

6. The heat exchanger tube (1) according to claim 4, wherein the thickness of the metal strip (11) is between 0.15 mm and 0.35 mm.

7. A heat exchanger for a motor vehicle, comprising a core of heat exchanger tubes (1) according to claim 4.

8. The method for producing a heat exchanger tube (1) according to claim 1, wherein the gap $h_e$ is between 50 μm and 70 μm.

9. The heat exchanger tube (1) according to claim 4, wherein the height ($h_s$) of the projection (50) is selected such that the distance between the projection (50) and the ends (12*a*, 12*b*) of the opposing edges (11*a*, 11*b*) is less than 100 μm.

10. The heat exchanger tube (1) according to claim 4, wherein the gap ($h_e$) is between 30 μm and 200 μm.

11. The heat exchanger tube (1) according to claim 4, wherein the metal strip (11) of the tube (1) has a substantially B-shaped cross section having a first large face (43) and a second large face (44) which are parallel and interconnected by two small curved faces, with the first large face (43) being substantially planar along its length between each respective one of the two small curved faces and the internal partition (19), and wherein the internal partition (19) originates from the first large face (43) opposite the projection (50) positioned on the internal wall (15) of the second large face (44).

* * * * *